United States Patent [19]

Wilson et al.

[11] 3,982,806

[45] Sept. 28, 1976

[54] PLUG-IN ELECTRIC CONTACT WITH IMPROVED CONTACT FINGER SUPPORT AND SHIELDING

[75] Inventors: Walter M. Wilson; John W. Katzbeck, Jr., both of Greensburg, Pa.

[73] Assignee: I-T-E Imperial Corporation, Spring House, Pa.

[22] Filed: Apr. 3, 1975

[21] Appl. No.: 564,695

[52] U.S. Cl. ..... 339/64 R; 339/255 P

[51] Int. Cl.[2] ..... H01R 13/62

[58] Field of Search ..... 339/64, 255

[56] References Cited

UNITED STATES PATENTS

| | | | |
|---|---|---|---|
| 2,243,567 | 5/1941 | Linde | 339/64 R |
| 2,265,006 | 12/1941 | Rubel et al. | 339/64 R |
| 3,713,075 | 1/1973 | Clark | 339/255 R |

*Primary Examiner*—Joseph H. McGlynn
*Attorney, Agent, or Firm*—Ostrolenk, Faber, Gerb & Soffen

[57] ABSTRACT

Inner conductors of isolated phase bus sections arranged end to end are joined by a multiplicity of longitudinally extending, annularly arrayed contact fingers which are biased radially inwardly against the conductors being joined with one end of each finger riding in a groove provided therefor on the exterior of one conductor and the other end of the finger being biased against the end of the next adjacent conductor to make slidable contact engagement therewith; a single dielectric shield surrounds both ends of the conductors and the contact fingers and is non-rigidly fastened at its longitudinal ends to the respective shells around each of the endwise adjacent conductors; springs extend between the shield and the fingers to bias the fingers against the conductors; the shield and finger arrangements permit the maximum width for the inner conductors enabling maximum quantities of contact fingers to be used and this arrangement also permits great misalignment between conductors, or tilting of one conductor with respect to the other and enables compensating for ambient condition caused contraction and expansion of the conductors themselves.

14 Claims, 3 Drawing Figures

PLUG-IN ELECTRIC CONTACT WITH IMPROVED CONTACT FINGER SUPPORT AND SHIELDING

The present invention relates to electric power transmission buses, particularly isolated phase buses employed in the electric power transmission and distribution field. More particularly, the invention relates to a novel electric conductor assembly that serves the functions of providing electrical engagement between bus system central conductors arranged end-to-end that are movable with respect to each other. The assembly provides excellent dielectric shielding and reduces the electric stress which might otherwise occur as a result of contraction and expansion of the conductors. The assembly also maximizes the electric contact between the endwise facing conductors and tolerates considerable misalignment and tilting of the endwise facing conductors with respect to each other. The invention is an improvement upon and variation from U.S. Pat. No. 3,713,075, issued Jan. 23, 1973 to Robert M. Clark, entitled "Dielectric Shield for Plug-in Contact" and assigned to the assignee hereof, incorporated herein by reference.

Isolated phase bus systems find widespread use in electric power transmission and are typically employed for the transmission and distribution of electric power at extremely high voltages and currents. One advantage of such systems is that they occupy much less space than conventional transmission and distribution lines.

An isolated phase bus system is normally comprised of a central conductor of tubular design that is positioned and supported within a surrounding conductive housing and that is maintained concentric with the central conductor by means of insulating spacers arranged at spaced intervals along the bus sections.

A bus run is typically comprised of a plurality of bus sections mechanically and electrically connected in end-to-end fashion. The sections are joined by suitable conductive structures to maintain and preserve the conductive paths along the entire bus run. The central conductors are usually connected by flexible conductive straps or by a conductive finger arrangement, such as that shown in aforesaid U.S. Pat. No. 3,713,075, or the like.

A bus run experiences expansion and/or contraction in operation, which are typically caused by ambient temperature changes or by heating and/or cooling of the bus sections as they carry more or less current.

In bus sections of the type described above, high dielectric stress occurs at the surface of the inner or central conductor. As the conductor contracts and expands, a gap is created between the conductor sections, which gap is of greater or lesser length resulting in higher voltage gradients at the exposed edges of the spaced adjacent conductor section ends. Since the current and voltage ratings are extremely high, the dielectric stress is capable of causing severe damage to the bus run.

The present invention provides a novel arrangement for conductively joining and maintaining the integrity of the conductive path between endwise adjacent central conductor sections arranged end-to-end. The invention incorporates a dielectric shield for controlling electric stresses encountered. It also provides maximum points of electric contact between the adjacent conductor sections by providing, inter alia, that the central conductors at the end sections where they are in electrical engagement with each other be relatively quite wide to provide maximum surface area to which the contact fingers may engage.

The present invention is comprised of first and second plugs which are mechanically and electrically connected to the ends of adjacent central conductor sections provided within an isolated phase bus system. The first of the plugs is provided with an annular groove adjacent its free end. The second of the plugs is provided with a cylindrically shaped projection of reduced diameter as compared with the diameter of the central conductors being electrically joined.

Extending axially of the conductors, annularly surrounding them and extending completely across the plug sections where adjacent conductors are electrically joined one to the other, from a point beyond the female plug to a point beyond the male plug, there is a unitary metallic dielectric shield. As one feature of the invention, the dielectric shield is mechanically held in position by an appropriate respective support ring located on the outside of each conductor section. The dielectric shield is not welded or otherwise rigidly fastened to the conductor sections. For this reason, the dielectric shield can axially shift and also tilt to a significant extent to absorb conductor misalignment and significant expansions and contractions while still being held in the desired position.

On the interior surface of the dielectric shield is provided a radially inwardly projecting annular fixture which has a annular array of a plurality of axially aligned slots each being adapted to receive an associated biasing member and contact finger.

Contact fingers are provided having projecting lobes at each of their free ends. The projecting lobes at one end of all of the contact fingers are received by the aforementioned annular groove in one plug. The annular groove positions the fingers and holds them against axial mispositioning. The lobes at the opposite end of all of the contact fingers are adapted to make wiping or sliding engagement with the aforementioned cylindrical projection. The annular fixture slot side walls hold the contact fingers annularly at their proper positions. The springs continuously bias the contact fingers against the two adjacent conductor plugs. No additional fastening means are required for holding the fingers in position.

Because the dielectric shield is a single unit, and does not have a number of sections with various different radial dimensions, the plugs of the adjacent conductors can be of a maximum width, limited only by the height thickness of the contact fingers and the biasing springs thereof. This maximization of the widths of the plugs increases the circumferences of the plugs, which provides a longer length surface against which conductive fingers may be biased. This increases the conductivity of the plug connection between the adjacent conductors so that the joint itself between the conductors does not become a concentrated heat source. The current carrying capacity of the plug connection is accordingly increased. In addition, the complexity of the plug connection is decreased due to a reduction in the number of components thereof, as compared, for instance, with U.S. Pat. No. 3,713,075.

The wiping of sliding engagement of the contact fingers with one of the plugs, particularly the male plug, allows for normal expansion and contraction of the separate (but connected) conductors in each section of the isolated phase bus system. However, the combined dielectric shield and contact finger assembly is maintained substantially stationary, enabling the first and second cylindrical envelopes and the cylindrically shaped dielectric shield to cooperatively serve to maintain the electric field pattern in the region of the joined inner conductors regardless of the amount of relative movement between the joined electric conductors.

The system according to the invention can be used with an isolated phase bus system, or with each phase of a multiphase system.

It is, therefore, one object of the present invention to provide a novel combined dielectric shield and contact finger assembly for electrically joining central conductors of an isolated phase or a multiphase bus system while maintaining the dielectric stress pattern regardless of any relative movement which may occur between the electrically joined inner conductors.

Another object of the present invention is to provide a novel combination dielectric shield and contact finger assembly comprised of a cylindrically shaped shield member having means for receiving an associated biasing member and a contact finger which is adapted to electrically engage the adjacent free end of the conductors to be joined so as to eliminate any need for conventional fastening means.

It is a further object of the invention to provide such a novel combination dielectric shield and contact finger assembly which improves the electric conductivity of the connection between adjacent conductors.

It is yet another object of the invention to be able to accomplish the foregoing objects by increasing the diameters of the adjacent plugs of the conductors being joined.

These as well as other objects of the invention will become apparent upon reading the following description of the accompanying drawings, in which.

With a multiphase bus system, each of the phases and the connections between conductors will be of similar design. Thus, the description herein applies to a bus run for each phase of a multiphase system or to an isolated phase bus run.

Figure 1:
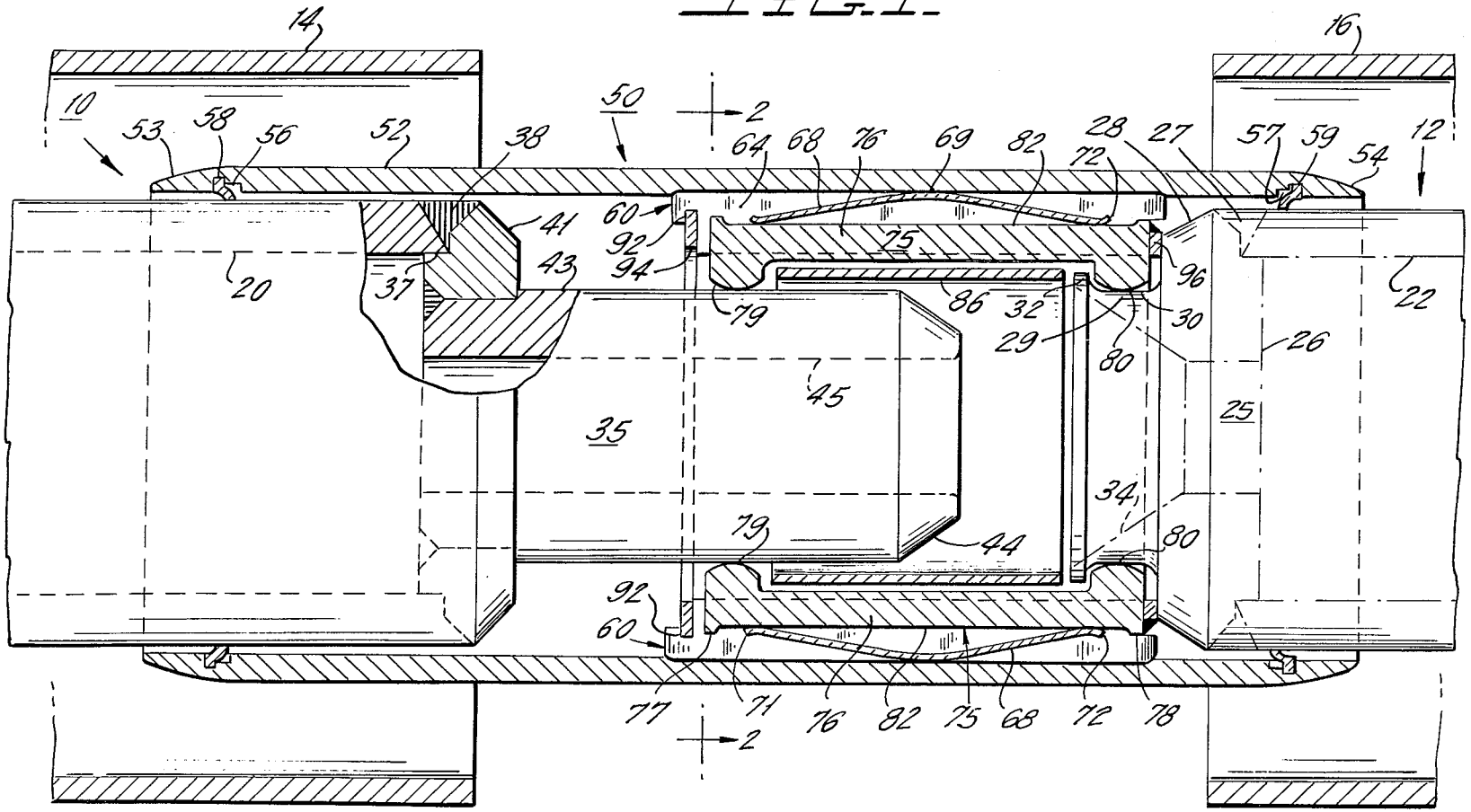
FIG. 1 is an elevational view, partially sectionalized, of a portion of an isolated phase bus system employing the novel dielectric shield and electric contact assembly of the present invention.
Figure 3:
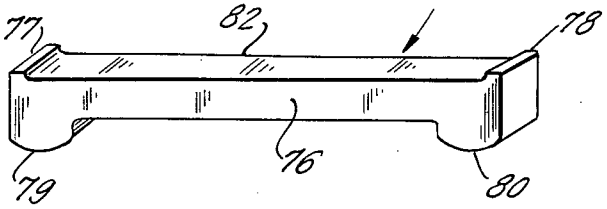
FIG. 3 is a side, perspective view of one of the plurality of contact fingers of FIG. 1.

Turning to the drawings, FIG. 1 shows conductors 10 and 12 of an isolated phase bus system. Each bus section conductor 10, 12 is comprised of a respective conductive tubular shaped enclosure 14, 16 that surrounds and is concentrically aligned with the respective, annular central conductors 20, 22. conductors 20, 22 are of substantially the same diameter. They are maintained in concentric alignment by means of insulating spacers (not shown) arranged at spaced intervals along each bus section. Details of typical bus sections are set forth in U.S. Pat. Nos. 3,573,341 and 3,573,342. The relative spacing between inner and outer conductors 14, 20 and 16, 22 has been reduced in FIG. 1 for purposes of simplicity of illustration. The conductive enclosure housings 14, 16 of adjacent bus sections are mechanically and electrically joined to one another by suitable means described in detail in U.S. Pat. No. 3,573,342, incorporated herein by reference.

A female plug 25 is secured to the left-hand end of the cnetral conductor 22 by means of the end adaptor 26 and the weld or soldered connection 27. Plug 25 includes the enlarged diameter flange portion 28 which receives connection 27, the relatively smaller diameter axially projecting portion 29 and the annular indent groove 30 in projecting portion 29. Plug 25 is nearly the width of conductor 22, but is narrowed enough to receive below described spring 68 and finger 75. Groove 30 is defined on its left side in FIG. 1 by radially outward projection 32 and on its right side by flange 28. Plug 25 is further provided with a central opening 34 that is a continuation of the opening through conductor 22 and that is shaped to receive the below described male plug 35. The axial length of annular groove 30 is greater than that of below described lobe 80 of contact finger 75 to provide space for the below described retainer ring 96.

At the right-hand end in FIG. 1 of central conductor 20, male plug 35 is secured by means of insert portion 37 extending into the hollow conductor 20 and the weldment or soldered connection 38, which securely holds plug 35 to conductor 20. Male plug 35 includes enlarged diameter connecting flange 41 that is secured by connection 38 to conductor 20. Adjacent to flange 41 is the reduced diameter axial projection 43 which extends a distance to its beveled, annular end 44 whose taper mates with that of female opening 34 to establish the point of maximum movement toward the right of plug 35. Plug 35 is also nearly the diameter of its conductor 20, but is narrowed to receive spring 68 and finger 75. Plug 35 is hollow, whereby it defines a conductive shell 45.

Under ideal conditions, conductors 20 and 22 are brought together in alignment, are not tilted with respect to each other and their alignment and relative positions are insignificantly affected by changes in ambient conditions and in electric current levels. However, in practice, conductors are frequently imperfectly aligned and ambient weather or the like conditions and also the presence of absence of current cause sever expansions and/or contractions and shiftings in relative positions and alignment. The manner of electrically connecting the conductors 20, 22 and of dielectrically shielding that connection is designed to accommodate the aforesaid misalignment and ambient condition shifts.

There is a combined contact finger support and dielectric shielding assembly 50, which is comprised of a substantially cylindrical shield member 52 with a smooth, substantially circular cross-sectioned, substantially constant external diameter outer surface which gradually tapers narrow in the vicinity of its opposite ends 53, 54. The length of shield member 52 is sufficient to extend across the entire space between the facing ends of the internal conductors 20, 22, and therefore across both entire plugs and a short distance over the end portions of the conductors 20, 22. The entire shield member 52 is comprised of a single cylindrical length of material, although it could be axially sectioned, so long as it has the other characteristics recited therein. The shield member is thick enough both to provide dielectric shielding and to serve as an adequate abutment against below described springs 68 operating on the contact fingers, but it is otherwise sufficiently thin to maximize the permissible diameter of the plugs 25, 35.

A short distance inward from end portions 53, 54, there are formed into the interior surface of shield member 52 respective annular receiving grooves 56, 57 for receiving respective outwardly projecting, annular, soft rubber material, resilient wiper rings 58, 59, which rings are fixedly secured to and project from the external surfaces of conductor portions 20, 22, respectively. Rings 58, 59 allow longitudinal motion and angular deflection and tilting of conductor portions 20, 22 with respect to shield member 52 and they seal the space between them and thereby the entire plugged joint against entrance of any contaminants. Grooves 56, 57 are sized larger than their rings 58, 59 to permit the deflection of rings 58, 59. All of the above is provided so that in the event of misalignment between conductor sections 10, 12, dielectric shield 52 can shift with respect to the conductor axes without allowing entry of contaminants or weakening of any mechanical or electrical connections, while also offering minimal resistance to such shift.

Figure 2:
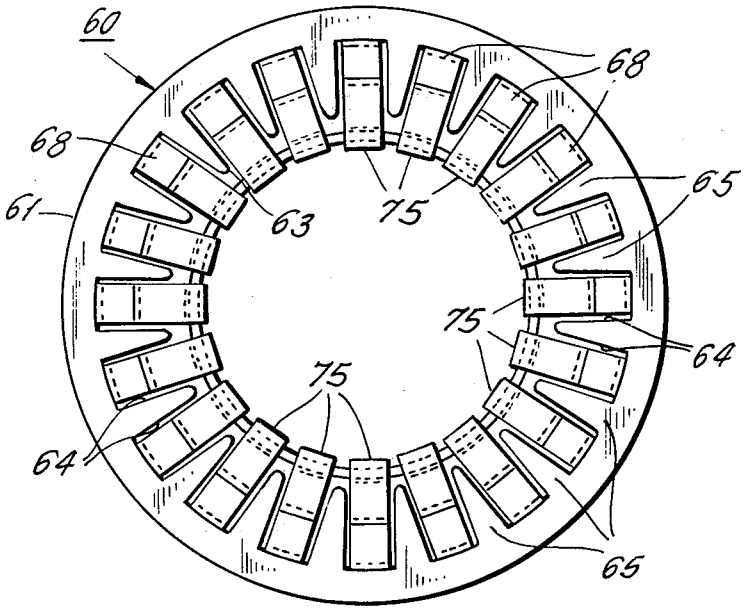
FIG. 2 is an end view of the dielectric shield and contact finger assembly of FIG. 1, looking in the direction of arrows 2 in FIG. 1.

Secured to or integral with shield 52 and on the interior thereof is the contact finger supporting fixture 60, which is formed of aluminum and is located along shield 52 so as to be over below described contact fingers 75 when the bus system is assembled. As shown in FIG. 2, the fixture 60 is annular and has a substantial radial thickness between its periphery 61 and its interior side 63. Formed into the interior side 63 are a plurality of axially aligned, axially extending, annularly arrayed, regularly spaced contact finger guiding and supporting recesses 64. Each recess 64 is defined between a pair of spaced apart, radially aligned fixture projections 65. Each recess 64 receives and positions an elongated, arcuately shaped resilient leaf spring 68. Each spring is positioned with the convex surface of its central portion 69 engaging the base of its associated recess 64.

The free ends 71, 72 of spring 68 are positioned to bear against a respective, conductive contact finger 75. Each contact finger 75 is a solid copper member, preferably silver plated, and having an elongated body portion 76. Provided at opposite ends of the upper surface of finger 75 are first and second end projections 77, 78 which ensure retention of spring 68 over the contact finger 75. Finger 75 is provided at opposite ends of its inner surface with a pair of electric contact lobes 79, 80. Each lobe 79, 80 has a respective, curvedly shaped, radially inwardly facing contact surface for engaging the respective plug 25 or 35. Lobes 79, 80 are rounded so that in the event of misalignment between plugs 25, 35, the contact fingers 75 can twist from their straight, axial to a tilt, non-axial condition while still maintaining adequate electric contact. For this purpose also, groove 30 is not closely shaped to lobe 80, so that the lobe can twist in the groove and still maintain electrical contact against the bottom of the groove. When it is in position, contact finger 75 securely contacts both plug 25 in groove 30 and surface 43 of male plug 35. Upon axial shifting of plugs 25, 35 with respect to each other, plug surface 43 slides past lobe 79.

The free ends 71, 72 of spring 68 bear against external surface 82 of contact finger 75. Projections 77, 78 limit the amount of relative motion between contact fingers 75 and their associated biasing springs 68.

Biasing springs 68 urge their associated contact fingers 75 inwardly toward the plug surfaces 29, 43. The external diameters of plugs 25, 35 and the thickness of contact fingers 75 is coordinated with the biasing forces of springs 68 to maintain the fingers under proper compression to hold lobes 79, 80 against the plugs.

The dielectric shield contact finger assembly is further comprised of an inner, hollow, cylindrically shaped contact finger retainer 86, which is of a diameter such that lobes 79, 80 project radially inwardly a further distance, whereby retainer 86 is trapped between lobes 79, 80. Retainer 86 is engaged by inwardly biased fingers 75 when plug 35 is withdrawn, whereby retainer 86 prevents fingers 75 and springs 68 from falling out of recesses 64.

Cylindrical fixture 60 includes an annular slot 92 at its male plug connector facing end in which is carried a snapped-in annular ring 94, the exterior diameter of which is sufficient that it immovably rests in slot 92 and the interior diameter of which is such that ring 94 serves as an abutment against motion of contact finger 75 too far to the left in FIG. 1.

To the right of contact finger 75, in the groove 30 is positioned and welded an annular retainer ring 96, one of whose function is to help more closely define the axial length of groove 30 in which lobe 80 can be positioned, thereby to cause contact finger 75 to shift axially along with the axial shifting of female plug. Rings 94, 96 could both be welded or snapped-in rings. Rings 94, 96 cooperatively retain fingers 75 and thereby springs 68 in support 60 affixed to shield 52. Therefore, lobe 80 of finger 75, through the other retaining elements, anchors the whole shield assembly 50 to plug 25, thereby ensuring that all relative longitudinal motion is between lobes 79 and plug surface 43.

Despite the unwelded and relatively free shifting connection between dielectric shield 52 and conductors 20, 22, the rounded central portion 69 of spring 68 cooperates with the interior surface of shield 52, and no matter how that shield tilts due to misalignment of conductors 20, 22, the shield still applies an inwardly directed force against base portion 69 of spring 68, and through the spring, against the rounded bases of lobes 79, 80. This ensures continuous contact between lobes 79, 80 and connectors 25, 35 despite tilting and misalignment and axial shifting of the connector plugs 25, 35.

Even more significant is the relative thinness of the dielectric shield and the manner in which the dielectric shield permits contact fingers 75 to be spaced relatively far from the center of conductors 20, 22, thereby permitting plug conductors 29, 45 to be of relatively large diameter. A larger diameter plug has a larger surface area circumference and is able to accommodate a greater number of contact fingers and/or contact fingers with a greater surface area, providing a better electrical connection which is less likely to overheat.

Other design features and a technique for assembly of a bus system employing the invention can be learned by a person skilled in the art from U.S. Pat. No. 3,713,075.

From the foregoing description, it can be seen that the present invention provides a novel dielectric shield-contact finger assembly which maintains the integrity of the dielectric shielding structure and of the electric conductor path between a pair of spaced inner conductors of a bus system, despite relative motion between the conductors resulting from normal expansion and contraction of the conductors with ambient conditions and despite misalignment between the conductors, or the like problems, which occur in use.

Although the present invention has been described in connection with a preferred embodiment thereof, many variations and modifications will now become apparent to those skilled in the art. It is preferred, therefore, that the present invention be limited not by the specific disclosure herein, but only by the appended claims.

We claim:

1. A plug type connector assembly, comprising:

first and second annular conductors of substantially equal diameter, surrounded by an annular conductive housing; each of said conductors having an end adjacently spaced from the end of the other said conductor;

each said adjacent end of said first and said second conductors having an axial, conductive plug element of diameter reduced from that of the external diameter of said first and said second conductors to a slight extent;

an annular, hollow shield of conductive material having a substantially constant internal diameter that is slightly greater than the external diameters of said first and said second conductors, said shield extending completely across both said plug elements and extending a short distance over both said conductors; retaining means for holding said shield in place over said first and second conductors and across said plug elements;

a plurality of axially extending, elongated contact fingers which are annularly arrayed at spaced intervals about the interior of said shield; said contact fingers each having a pair of radially inwardly directed contact lobes, one at each free end of each said finger; the inward end of one said lobe engaging the external surface of one said plug element and the inward of the other said lobe engaging the external surface of the other said plug element;

a first one of said plug elements having an annular groove for receiving and seating the associated inward end of one said contact lobe of each of said contact fingers to substantially prevent linear movement of said contact fingers relative to said annular groove while the inward end of the remaining contact lobe of each of said contact fingers makes sliding engagement with the associated second one of said plug elements to maintain good electrical engagement between both said lobes and their associated said plug elements, while enabling relative movement between said first and said second conductors;

finger support and positioning means provided along the interior of said shield and engaging said shield and said contact fingers for maintaining each of said contact fingers at spaced intervals around the inner periphery of said shield; biasing means for urging each of said fingers inwardly toward said plug elements and away from the interior surface of said shield, whereby said plug elements may have relatively large diameter because the space between them and said shield contains said fingers and said biasing means for urging said fingers.

2. The connector assembly of claim 1, further comprising means for mechanically, but not rididdly, and relatively movably fastening said shield to the exterior of both said conductors, thereby to enable relative shifting and tilting between said conductors, without adversely affecting the said shield to conductor fastening.

3. The connector assembly of claims 1, wherein said finger support and positioning means is comprised of a plurality of axial recesses arranged at spaced intervals around said interior surface of said shield, each said recess being for receiving an associated one of said contact fingers.

4. The connector assembly of claim 3, wherein said recesses are defined in an annular fixture attached on said interior surface of said shield, and said recesses are of a depth such that such finger biasing means engage the interior of said shield.

5. The connector assembly of claim 4, wherein at the end of said fixture away from said plug element annular groove, said fixture carries an annular ring extending into said recesses and being of a width to block shifting of said fingers axially out of said fixture.

6. The connector assembly of claim 4, wherein in said plug element annular groove is positioned an annular ring which is axially next to all of said fingers and which fills the remainder of said annular groove not filled by the said finger lobe at the end of each said finger.

7. The connector assembly of claim 6, wherein at the end of said fixture away from said plug element annular groove, said fixture carries an annular ring extending into said recesses and being of a width to block shifting of said fingers axially out of said fixture.

8. The connector assembly of claim 7, further comprising means for mechanically, but not rigidly, and relatively movably fastening said shield to the exterior of both said conductors, thereby to enable relative shifting and tilting between said conductors, without adversely affecting the said shield to conductor fastening.

9. The connector assembly of claim 8, wherein said means for fastening said shield comprises a respective soft and resilient projection extending outwardly from each conductor, and a respective groove on the interior of said shield above each respective soft projection for receiving same.

10. The connector assembly of claim 4, wherein said biasing means includes members positioned in each of said recesses for urging each of their associated said contact fingers toward engagement with both said plug elements.

11. The connector assembly of claim 10, wherein said biasing means members are each comprised of an elongated arcuately shaped leaf spring having its central portion engaging through its associated recess upon said shield internal surface and having its opposite free ends engaging its associated said contact finger near the opposite ends thereof.

12. The connector assembly of claim 11, wherein each of said contact fingers is provided with a pair of outward projections at its said free ends to limit the relative linear movement between each said contact finger and its associated said spring.

13. A plug type connector assembly, comprising:

first and second annular conductors of substantially equal diameter, surrounded by an annular conductive housing; each of said conductors having an end adjacently spaced from the end of the outer said conductor;

each said adjacent end of said first and said second conductors having an axial, conductive plug element of diameter reduced from that of the external diameter of said first and said second conductors to a slight extent;

an annular, hollow shield of conductive material having a substantially constant internal diameter that is slightly greater than the external diameters of said first and said second conductors, said shield extending completely across both said plug elements and extending a short distance over both said conductors; retaining means for holding said shield in place over said first and second conductors and across said plug elements;

a plurality of axially extending, elongated contact fingers which are annularly arrayed at spaced intervals about the interior of said shield; said contact fingers each having a radially inwardly directed contact lobe at one end of each said finger; the inward end of each of said contact lobes of each of said contact fingers engaging the external surface of one of said plug elements, the ends of each of said fingers opposite to said end containing said contact lobe being fixed to the other said plug element;

said inwardly directed contact lobes extending from each of said contact fingers making sliding engagement with said one of said plug elements to maintain good electrical engagement between said plug elements while enabling relative movement between said first and said second conductors;

respective spring biasing means provided along the interior of said shield for each of said contact fingers and engaging said shield and said respective contact fingers; said spring biasing means urging each of said fingers inwardly and away from the interior surface of said shield, whereby said plug elements may have relatively large diameter because the space between them and said shield contains said fingers and said biasing means for urging said fingers.

14. The connector assembly of claim 13, further comprising means for mechanically, but not rigidly, and relatively movably fastening said shield to the exterior of both said conductors, thereby to enable relative shifting and tilting between said conductors, without adversely affecting the said shield to conductor fastening.

* * * * *